US008302604B2

(12) United States Patent
Rittner et al.

(10) Patent No.: US 8,302,604 B2
(45) Date of Patent: Nov. 6, 2012

(54) COCKPIT OXYGEN MASK

(75) Inventors: Wolfgang Rittner, Siblin (DE); Rudiger Meckes, Berkenthin (DE)

(73) Assignee: B/E Aerospace Systems GmbH, Lubeck (DE)

( * ) Notice: Subject to any disclaimer, the term of this patent is extended or adjusted under 35 U.S.C. 154(b) by 993 days.

(21) Appl. No.: 11/773,154

(22) Filed: Jul. 3, 2007

(65) Prior Publication Data

US 2008/0035150 A1 Feb. 14, 2008

(30) Foreign Application Priority Data

Jul. 4, 2006 (DE) ..... 10 2006 030 668

(51) Int. Cl.
*A62B 9/02* (2006.01)

(52) U.S. Cl. ..... 128/205.24; 128/204.18; 128/205.25; 128/206.21

(58) Field of Classification Search ..... 128/204.18, 128/204.19, 204.21, 204.22, 205.24, 205.25, 128/206.21, 206.28, 207.12; 244/118.5
See application file for complete search history.

(56) References Cited

U.S. PATENT DOCUMENTS 2,596,178 A * 5/1952 Seeler ..... 128/204.28
2,954,793 A * 10/1960 Seeler ..... 137/512.2
3,039,481 A * 6/1962 Schreiber et al. ..... 137/102
3,890,968 A * 6/1975 Pierce et al. ..... 604/65
4,345,592 A * 8/1982 Giorgini et al. ..... 128/204.26
4,658,858 A 4/1987 Beale
4,827,964 A * 5/1989 Guido et al. ..... 137/81.1
2001/0035188 A1 11/2001 Gleason et al.
2007/0084469 A1 * 4/2007 McDonald et al. ..... 128/206.21

FOREIGN PATENT DOCUMENTS

EP 1052441 A3 7/2002
GB 1106431 3/1968
GB 1106431 A 3/1968
GB 2416701 A 2/2006

OTHER PUBLICATIONS

Office Action Issued Sep. 30, 2010 in British Application Serial No. GB0712940.6.

* cited by examiner

*Primary Examiner* — Justine Yu
*Assistant Examiner* — LaToya M Louis
(74) *Attorney, Agent, or Firm* — Panitch Schwarze Belisario & Nadel LLP

(57) ABSTRACT

A cockpit oxygen mask includes a mask body, an oxygen inhalation valve, a mixed air inhalation valve, an exhalation valve as well as a control device. At least the oxygen inhalation valve is signal-connected to the control device. The oxygen inhalation valve is designed as an electromagnetically actuatable valve, and includes at least one through flow path which may be closed by a magnetically movable valve body, wherein the through flow path is limited by a magnetizable wall, and wherein the wall includes at least one discontinuous location which deforms a magnetic field produced in the wall.

7 Claims, 1 Drawing Sheet

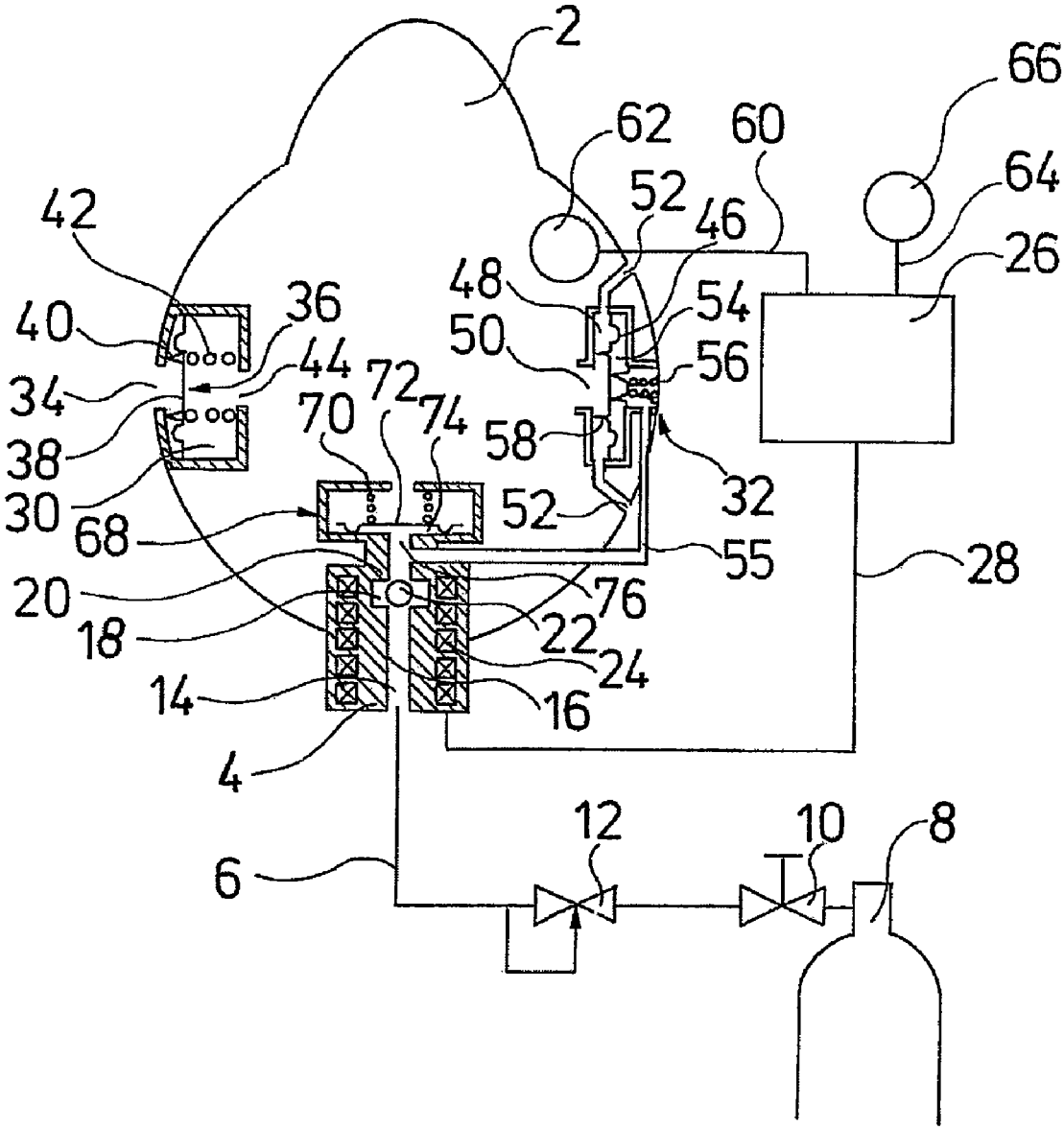
2
66
62
60
64
52
46
42
26
48
54
36
40
50
56
44
72
34
70
74
58
38
32
30
52
68
55
28
20
76
18
22
24
14
16
4
12
10
8
6

COCKPIT OXYGEN MASK

BACKGROUND OF THE INVENTION

The invention relates to a cockpit oxygen mask with the features specified in the below specification.

With the oxygen supply systems for cockpit crews used in aircraft, for reasons of weight and space, one strives to keep the quantity or oxygen which is brought along in the aircraft as small as possible. Thereby however, one should ensure an adequate oxygen supply of the cockpit crew. This demands an as efficient as possible utilization of the oxygen which is carried on board. Oxygen losses must be avoided.

In this context, cockpit oxygen masks and in particular their pressure regulators are of significance. With the cockpit oxygen masks known until now, the sluggish regulation (closed-loop control) behavior of the mechanically designed pressure regulator leads to a relatively large quantity of oxygen which is not used, being consumed, since the pressure regulation valve of the pressure regulator may only meter the oxygen quantity led into the cockpit oxygen mask in an inadequate manner, and only reacts with a delay to the requirement situation.

BRIEF SUMMARY OF THE INVENTION

Against this background, it is the object of the invention to provide a cockpit oxygen mask which ensures an adequate oxygen supply of the user, with as little as possible oxygen consumption.

This object is achieved by a cockpit oxygen mask with the features specified in the below description of the device. Advantageous further designs of the invention are to be deduced from the detailed description and the drawing of the device.

The cockpit oxygen mask according to the invention may be designed as a half-mask or full mask, with or without a breathing bag. In the known manner, it comprises a mask body, an oxygen inhalation valve, a mixed air inhalation valve, as well as a control device. At least the oxygen inhalation valve is signal-connected to this control device.

According to the invention, the oxygen inhalation valve is designed as an electromagnetically actuatable valve, preferably as an electromagnetically actuatable ball-seat valve, which comprises at least one throughflow path which may be closed by a magnetically movable valve body. The throughflow path is limited by a magnetizable wall, wherein the wall comprises at least one discontinuous location, which deforms a magnetic field produced in the wall.

A magnet valve designed in such a manner is described in DE 199 22 414 C1. Preferably, with this magnet valve, a magnetic field running parallel to the wall is produced in a wall limiting the flow path by way of a coil subjected to current. An discontinuous location in the form of a groove is provided in the wall, which leads to a concentration of the magnetic field, in a manner such that the magnetic field extends further into the flow path in the region of the discontinuous location, and thus may affect the valve body arranged in the throughflow path, and may move it away from the valve seat. Furthermore, the magnet valve is designed such that the fluid pressure prevailing at the entry side of the valve, presses the valve body against the valve seat when the wall of the throughflow path is not magnetized, and in this manner automatically closes the throughflow path. The magnet valve advantageously has a small constructional size and a low weight.

A particular advantage of magnet valves of the above-described type, is above all its switching behavior. One may realize switch times which lie in the millisecond range. The use of such a magnet valve as an oxygen inhalation valve of a cockpit oxygen mask thus permits an exact metering of the oxygen with a very low regulation tolerance. By way of this, the cockpit oxygen mask according to the invention ensures a particularly efficient utilization of the oxygen which is available. Accordingly, the oxygen quantity which is carried along on board may be significantly reduced.

Further advantageously, the weight and the construction size of the applied oxygen inhalation valve are significantly lower than inhalation valves used until now, so that the wearing comfort of the cockpit oxygen mask according to the invention may be improved compared to known masks of this type.

For increasing the operational reliability and for increasing the possible throughput volume flows, the oxygen inhalation valve preferably comprises not only one, but at least two throughflow paths, which may be closed in each case by a valve body. This redundancy ensures the operational capability of the oxygen inhalation valve even if one of the valve bodies may not be moved from its position closing the throughflow path, on account of a defect. In this case, at least one further throughflow path is available, via which the oxygen may be introduced into the mask body for ventilation of the user.

The oxygen inhalation valve may for example comprise two or more throughflow paths led in parallel, in which in each case a valve seat corresponding to the valve body arranged in the throughflow path is formed. Thereby, a discontinuous location, preferably in the form of a groove on the peripheral side, may be provided on the onflow side of the valve seats in each of the throughflow paths. The valve bodies may be moved away from the valve seats and thus release the throughflow paths by way of magnetization of the walls of the throughflow paths.

A coil which may be subjected to current and which is arranged in a manner such that all throughflow paths run through the inside of the coil, may be provided for magnetizing the walls of the throughflow paths. This design permits the simultaneous opening of all throughflow paths by way of subjecting the coil to current. It is however also possible to assign a coil which may be subjected to current, to each throughflow path, so that each throughflow path is surrounded by its own coil. This further formation advantageously permits the throughflow paths of the oxygen inhalation valve to be opened or closed individually. Designed in this manner, with the oxygen inhalation valve, not only is the opening time, but also to a certain extent the effective throughflow cross section may be set via the number of throughflow paths activated to open and close, wherein the oxygen volume flow through the magnet valve and thus the oxygen quantity provided to the user of the cockpit oxygen mask is increased with an increasing number of throughflow paths actuated in an opening manner.

The oxygen inhalation valve advantageously forms a part of a pressure regulation device, with which the oxygen pressure in the mask body may be adapted to predefined nominal values. Accordingly, with the oxygen inhalation valve, the oxygen quantity led to the user of the cockpit oxygen mask may be set, since the oxygen quantity introduced into the mask body is directly proportional to the oxygen pressure in the mask body. The average pressure of about 2 to 3 bar which usually prevails on the entry side of the oxygen inhalation valve in oxygen supply systems may be regulated down to the desired mask pressure with the oxygen inhalation valve. This pressure regulation is effected preferably via the control of the opening times of the oxygen inhalation time, but with an oxygen inhalation valve which comprises several throughflow paths, may however be effected additionally via the number of open and closed throughflow paths.

The electromagnetically actuatable design of the oxygen inhalation valve, given a suitable control device, permits a multitude of different regulation concepts for the oxygen supply of the cockpit crew. Thus one may produce an essentially constant oxygen pressure in the mask body with a suitable activation of the oxygen inhalation valve. Apart from this, it is however also possible in combination with the mixed air inhalation valve, to realize a co-called impulse breathing regulation. With this, a limited bolus volume of oxygen is supplied to the user of the cockpit oxygen mask via the oxygen inhalation valve only in the initial inhalation phase, in which the oxygen is diffused into the arterial blood via the lung system. Subsequently, the cockpit air is supplied via the mixed air inhalation valve during the further inhalation phase. Thus the oxygen consumption may be further reduced with the impulse breathing regulation.

Usefully, a pressure sensor signal-connected to the control device is arranged in the mask body. This pressure sensor, given ventilation with pure oxygen, permits the equalization of the required desired value for the oxygen pressure in the mask body, with the actual pressure which indeed prevails in the mask body. For this, the pressure sensor detects the actual pressure prevailing in the mask body, and transfers the pressure values in the form of electrical signals via an electrical signal leads to the control device. Then, on the basis of these actual pressure values, via suitable hardware and/or software of the control device, one may determine the time intervals required for achieving the desired nominal pressure, in which time intervals the oxygen inhalation valve is activated in an opening or closing manner by the control device. Furthermore, it is possible with the pressure sensor, in particular with the impulse breathing regulation, to detect the exhalation pressure of the user of the cockpit oxygen mask, and to clock/cycle the opening times of the oxygen inhalation valve on the basis of these pressure values.

Basically, there also exists the possibility of arranging a pressure switch in the mask body instead of a pressure sensor, with which pressure switch the oxygen inhalation valve may be switched in a closing and opening manner in dependence on the mask pressure.

The control means of the cockpit oxygen mask is usefully signal-connected to a pressure sensor arranged outside the mask body, in order to be able to adapt the oxygen pressure in the mask body to the flight altitude or to the cockpit pressure. With this design, the control device may determine the opening times of the oxygen inhalation valve which are required for achieving the required pressure in the mask body dependent on flight altitude, on the basis of the cockpit pressure determined by the ambient pressure sensor, and of the actual pressure prevailing in the mask body.

In a further advantageous design of the invention, the exhalation valve and the oxygen inhalation valve are fluidically coupled to one another, in a manner such that the opened oxygen inhalation valve impinges the exhalation valve with pressure in a closing manner. Accordingly, the oxygen inhalation valve and the exhalation valve may not be simultaneously opened. In this manner, one prevents the oxygen which is introduced into the mask body via the oxygen inhalation valve, from flowing out of the mask body via the exhalation valve, without having been breathed in by the user of the cockpit oxygen mask.

Preferably, the oxygen inhalation valve comprises two exits. Thereby, a first exit opens into the mask body. This first exit accordingly serves for the oxygen supply of the user of the cockpit oxygen mask. A second exit is conductingly connected to the exhalation valve via an overflow channel. The fluidic coupling from the oxygen inhalation valve and the exhalation valve is effected via the overflow channel. For this, the overflow channel is preferably connected to the exhalation valve such that with an opened oxygen inhalation valve, a part flow of the oxygen flowing through the oxygen inhalation valve, flows into the exhalation valve via the overflow channel and there, presses a sealing body which closes a flow path leading from the inside of the mask body to the outside of the cockpit oxygen mask, against a valve seat in a closing manner, so that no oxygen may get lost via the overflow channel.

Preferably, a shut-off valve is arranged at the exit side of the oxygen inhalation valve in a manner such that it blocks a fluid flow from the mask body to the oxygen inhalation valve. With the shut-off valve, one prevents the exhalation procedure leading to a pressure increase in the overflow channel, which would activate the exhalation valve to close, so that the exhalation gas could not escape from the mask body. Preferably, the oxygen inhalation valve and the shut-off valve form a common construction unit. The shut-off valve may for example be designed as a spring-biased return valve, which is arranged in a manner such that a restoring spring and the exhalation pressure press a sealing body of the shut-off valve into a position closing the shut-off valve. Thereby, the restoring spring is usefully dimensioned such that the spring force which is exerted by it onto the sealing body, is smaller than the force which, given an opened oxygen inhalation valve, is exerted by the oxygen flow onto the sealing body.

BRIEF DESCRIPTION OF THE SEVERAL VIEWS OF THE DRAWINGS

The foregoing summary, as well as the following detailed description of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown.

In the drawings:

FIG. 1 is a basic sketch of a cockpit oxygen mask according to the invention.

DETAILED DESCRIPTION OF THE INVENTION

A cockpit oxygen mask with a mask body 2 is represented in a greatly simplified manner in the Figure. The mask body 2 comprises an oxygen inhalation valve 4 with which the oxygen supply into the inner space of the mask body 2 may be controlled. The oxygen inhalation valve 4 may be integrated into the mask body 2 or be arranged upstream of this, for example via a breathing bag which is not represented. The oxygen inhalation valve 4 is conductingly connected to an oxygen storer 8 via a supply conduit 6, wherein in the known manner, a shut-off valve 10 as well as a pressure reducer 12 are connected downstream of the oxygen storer 8 in the outflow direction. The oxygen pressure prevailing in the oxygen storer 8 and which may be more than 100 bar, is reduced by the pressure reducer 12 to an average pressure of about 2 to 3 bar.

The oxygen inhalation valve 4 is designed as an electrically actuatable ball-seat valve. It comprises a through flow path 14 which is limited by a magnetizable wall 16 of the valve housing. The cross section of the through flow path 14 widens to a valve chamber 18 within the valve housing. The cross-sectional transition from the valve chamber 18 to the flow path 14, on the downstream side and the side facing the mask body 2, forms a valve seat 20 for a ball-like valve body 22. The valve body 22 consists of a ferromagnetic material.

A recess which is not represented in the Figure, is provided on the peripheral side of the valve chamber 18, and this recess extends outwards in the radial direction over a limited peripheral region. A coil 24 which may be subjected to current, is arranged concentrically to the through flow path 14 in the wall 16 of the valve housing. A magnetic field running parallel to the wall 16 is produced in the valve housing by way subjecting the coil 24 to current. With this, in the region of the valve chamber 18, the recess formed on its peripheral side forms a discontinuous location in the magnetic field, by which means the magnetic field extends into the valve chamber 18 in the region of this recess, in a manner such that the magnetic field affects the valve body 22, and moves it away from the valve seat 20 to the peripheral side of the valve chamber 18. In this manner, the flow path 14 through the oxygen inhalation valve 4 is released. After completion of the subjection of the coil 24 to current, i.e. when the magnetic field in the valve housing is lifted, the valve body 22 is pressed by the oxygen pressure prevailing on the entry side of the oxygen inhalation valve 4, again against the valve seat 20, and the flow path 14 is closed. The subjection of the coil 24 to current is effected via an electronic control device 26 which is connected to the coil via a lead 28.

Apart from the oxygen inhalation valve 4, a mixed air inhalation valve 30 and an exhalation valve 32 are also arranged on the mask body 2. The mixed air inhalation valve 30, in cooperation with the oxygen inhalation valve 4, is provided in order to realize an impulse breathing regulation, with which in an initial inhalation phase, a bolus volume of pure oxygen is introduced into the mask body via the oxygen inhalation valve 4, and after closure of the oxygen inhalation valve 4, cockpit air is introduced into the mask body 2 via the mixed air inhalation valve 30.

The mixed air inhalation valve 30 is arranged in the inside of the mask body 2. The mask body 2 comprises an inlet opening 34 which is closed by a sealing body 36 of the mixed air inhalation valve 30. The sealing body 36 is formed by a membrane 38 and a sealing ring 40 which is formed on the membrane 38. In the closed condition of the mixed air inhalation valve 30, a spring 42 presses the membrane 38 in the direction of the inner wall of the mask body 2, in a manner such that the inlet opening 34 is enclosed by the sealing body 36. The inlet opening 34 is closed by the sealing body 36 by way of this. The mixed air inhalation valve comprises a further opening 44 for communication with the inner space of the mask body 2. During the inhalation phase in which the oxygen inhalation valve 4 is closed and the oxygen which has been previously introduced into the mask body 2 via the oxygen inhalation valve is breathed out, the side of the membrane 38 which is distant to the inlet opening 34 of the mask body 2, via this opening 44, is subjected to a vacuum due to further inhalation, and moved away from the mask body 2. By way of this, the sealing ring 40 bearing on the inner wall of the mask body 2 is also moved away from the inner wall, so that a flow path arises from the inlet opening 34 into the inside of the mask body 2.

The exhalation valve 32 is also arranged in the inside of the mask body 2. The valve housing of the exhalation valve 32 divides the membrane 46 into two valve parts. With this, a first valve part 48 forms a flow path from an inlet opening 50 in the inner space of the mask body 2 to a multitude of outlet openings 52 which are arranged on the outer side of the mask body 2. A second valve part 54 is in communication with the oxygen inhalation valve 4 via an overflow channel 55, wherein the overflow channel 55 connects the flow path 14 of the oxygen inhalation valve 4 at the exit side of the valve seat 20 closable by the valve body 22, to the second valve part 54 of the exhalation valve 32 in a fluidically conducting manner. A spring 56 is arranged in the second valve part 54 of the exhalation valve 32, and this spring biases the membrane 46 into the closure position of the exhalation valve 32. A sealing ring 58 is formed on the membrane 46 at its side facing the first valve part 48, and this sealing ring, when the membrane 46 is moved in the direction of the inlet opening 50 of the exhalation valve 32, closes the flow path from the inlet opening 50 to the multitude of outlet openings 52.

The control device 26 is signal-connected via an electrical lead 60 to a first pressure sensor 62, and via an electrical lead 64 to the second pressure sensor 66. The first pressure sensor 62 is arranged in the inner space of the mask body 2. The second pressure sensor 66 is arranged outside or on the outer side of the cockpit oxygen mask, and detects the ambient pressure prevailing in the cockpit of the aircraft.

A shut-off valve 68 connects directly to the oxygen inhalation valve 4 at the exit side of this, wherein the oxygen inhalation valve 4 and the shut-off valve 68 form a common construction unit. The shut-off valve 68 is designed in a spring-biased manner, wherein a spring 70 presses a valve disk 72 against a seat surface 74 which closes at the exit 76 of the oxygen inhalation valve 4. The spring 70 is dimensioned such that the valve disk 72, given an oxygen inhalation valve 4 switched to open, may be moved away from the seat surface 74 by the oxygen which then flows through the flow path 14, and the oxygen may thus flow into the mask body 2.

The manner of functioning of the cockpit oxygen mask according to the invention is described hereinafter by way of the figure.

Given an opened shut-off valve 10, oxygen flows via the supply conduit 6 from the oxygen storer 8 to the oxygen inhalation valve 4, and with a closed throughflow path 14 bears on this with a pressure of 2 to 3 bar. The control device 26 firstly initiates the subjection of the coil 24 to current, which is arranged in the wall 16 of the valve housing of the oxygen inhalation valve 4. A magnetic field is produced in the wall 16 by way of this. The valve body 22 of the oxygen inhalation valve 4 is moved away from the valve seat 20 transversely to the throughflow path 14 on account of the recess provided in the valve chamber 18, said recess forming a discontinuous location of the magnetic field. The oxygen may now flow into the mask body 2 via the shut-off valve 68. Thereby, the oxygen pressure is reduced from the average pressure of 2 to 3 bar prevailing at the entry side of the oxygen inhalation valve 4, to the required mask pressure.

For this, the oxygen pressure which builds up is constantly monitored in the mask body 2 by way of the pressure sensor 62. Thus a continuous desired-actual value compensation of the mask inner pressure is possible. The setting of the actual pressure is then effected by way of the control of the opening times of the oxygen inhalation valve 4, wherein an exact metering of the oxygen quantity is possible on account of the very short switching times.

The desired value for the mask inner pressure is not constant, but depends on the respective flight altitude, and accordingly on the ambient pressure prevailing in the cockpit. Thus the oxygen quantity introduced into the inner space of the mask body 2 is increased with an increasing flight altitude.

Whilst the oxygen flows via the oxygen inhalation valve 4 into the mask body 2, in the oxygen inhalation valve 4, a part flow of the oxygen is led via the overflow channel 55 into the second valve part 54 of the exhalation valve 32, where this part flow presses the membrane 46 in the direction of the inlet opening 50, which thereupon is closed by the membrane 46 and the sealing ring 58 formed thereon, so that with an opened oxygen inhalation valve, no oxygen may escape via the exhalation valve 32.

When the oxygen pressure in the mask body 2 reaches its desired value, the subjection of the coil 24 to current is ended by the control device. A magnetic force no longer acts on the valve body 22 of the oxygen inlet valve 4, and this valve is pressed by the oxygen flow on the entry side of the valve chamber 18, again into the position against the valve seat 20 closing the flow path.

During the exhalation phase, the shut-off valve 68 is closed after a pressure equalization between the second valve part 54 of the exhalation valve 32, and the inside of the mask body 2. The exhalation gas presses the membrane 46 of the exhalation valve 32 away from its position closing the inlet opening 50. The exhalation gas flows via the flow path which thus arises, from the inlet opening 50 through the outlet openings 52 out of the cockpit mask into the cockpit.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

The invention claimed is:

1. A cockpit oxygen mask comprising: a mask body (2), an oxygen inhalation valve (4), a mixed air inhalation valve (30), an exhalation valve (32) and a control device (26); wherein at least the oxygen inhalation valve (4) is signal-connected to the control device (26), wherein the oxygen inhalation valve (4) is designed as an electromagnetically actuatable valve with at least one through flow path (14) which may be closed by a magnetically movable valve body (22), wherein the through flow path (14) is limited by a magnetizable wall (16) and wherein the magnetizable wall (16) comprises at least one discontinuous location, which deforms a magnetic field produced in the magnetizable wall (16) to move the valve body and open the through flow path when the magnetizable wall is subjected to current, the oxygen inhalation valve fluidically coupled to the exhalation valve by an overflow channel and configured such that fluid pressure prevailing at an entry side of the through flow path of the oxygen inhalation valve presses the valve body against a valve seat when the through flow path is not magnetized and in this manner closes the through flow path, the overflow channel connects an exit side of the through flow path of the oxygen inhalation valve to a valve part of the exhalation valve, in a manner such that when the oxygen inhalation valve is opened the exhalation valve is impinged from opening by pressure applied to the valve part and a membrane of the exhalation valve in a closing manner, the overflow channel connected to the through flow path between the movable valve body and a movable valve disk of the oxygen inhalation valve, the oxygen inhalation valve comprises two exits, wherein a first exit runs into the mask body proximate the valve disk, and a second exit is conductingly connected via an overflow channel to the exhalation valve.

2. A cockpit oxygen mask according to claim 1, wherein the oxygen inhalation valve (4) comprises at least two through flow paths (14), which in each case may be closed with a valve body (22).

3. A cockpit oxygen mask according to claim 1, wherein the oxygen inhalation valve (4) forms part of a pressure regulation device.

4. A cockpit oxygen mask according to claim 1, wherein a pressure sensor (62) which is signal-connected to the control device (26), is arranged in the mask body (2).

5. A cockpit oxygen mask according to claim 1, wherein the control device (26) is signal-connected to a pressure sensor (66) arranged outside the mask body (2).

6. A cockpit oxyen mask according to claim 1, wherein, wherein a shut-off valve (68) is arranged on an exit side of the oxygen valvue (4) in a manner such that it blocks a fluid flow from the mask body (2) to the oxyen inhalation valve (4).

7. A cockpit oxygen mask comprising: a mask body, an oxygen inhalation valve, a mixed air inhalation valve, an exhalation valve and a control device, the oxygen inhalation valve being fluidically coupled to the exhalation valve by an overflow channel, the oxygen inhalation valve includes a first exit opening into the mask body and a second exit conductingly connected to the exhalation valve via the overflow channel, wherein at least the oxygen inhalation valve is signal-connected to the control device, wherein the oxygen inhalation valve is designed as an electromagnetically actuatable valve with at least one through flow path which may be closed by a magnetically movable valve body, wherein the through flow path is limited by a magnetizable wall having a coil therein and wherein the magnetizable wall comprises at least one discontinuous location, which deforms a magnetic field produced in the magnetizable wall to move the valve body and open the through flow path when the magnetizable wall is subjected to current using the coil, the oxygen inhalation valve configured such that fluid pressure prevailing at an entry side of the through flow path of the oxygen inhalation valve presses the valve body against a valve seat when the through flow path is not magnetized and in this manner closes the through flow path, the overflow channel connects the second exit to a valve part of the exhalation valve in a manner such that when the oxygen inhalation valve is opened the exhalation valve is impinged from opening by pressure applied to the valve part and a membrane of the exhalation valve in a closing manner, the second exit positioned between the movable valve body and a movable valve disk, the valve disk being proximate the first exit.

* * * * *